US011103801B2

(12) United States Patent
Vicentelli

(10) Patent No.: US 11,103,801 B2
(45) Date of Patent: Aug. 31, 2021

(54) MAGNETIC TOY BLOCK

(71) Applicant: GEOMAGWORLD S.A., Novazzano (CH)

(72) Inventor: Claudio Vicentelli, Alghero (IT)

(73) Assignee: GEOMAGWORLD S.A.

( * ) Notice: Subject to any disclaimer, the term of this patent is extended or adjusted under 35 U.S.C. 154(b) by 31 days.

(21) Appl. No.: 16/344,266

(22) PCT Filed: Oct. 26, 2017

(86) PCT No.: PCT/EP2017/077429
§ 371 (c)(1),
(2) Date: Apr. 23, 2019

(87) PCT Pub. No.: WO2018/083001
PCT Pub. Date: May 11, 2018

(65) Prior Publication Data

US 2019/0262737 A1 Aug. 29, 2019

(30) Foreign Application Priority Data

Nov. 3, 2016 (IT) ..... 102016000110762

(51) Int. Cl.
*A63H 33/04* (2006.01)
*A63H 33/06* (2006.01)
(Continued)

(52) U.S. Cl.
CPC ..... *A63H 33/046* (2013.01); *A63H 33/06* (2013.01); *A63H 33/26* (2013.01); *H01F 7/0221* (2013.01)

(58) Field of Classification Search
CPC ..... A63H 33/046; A63H 33/06; A63H 33/26
(Continued)

(56) References Cited

U.S. PATENT DOCUMENTS 2,795,893 A 6/1957 Vayo
2,872,754 A * 2/1959 Cronberger ..... A63H 33/046 446/92
(Continued)

FOREIGN PATENT DOCUMENTS

CN 103816674 A 5/2014
EP 0051576 A2 5/1982
(Continued)

*Primary Examiner* — Joseph B Baldori
(74) *Attorney, Agent, or Firm* — Laubscher & Laubscher, P.C.

(57) ABSTRACT

A magnetic toy block and a kit suitable for the composition of toy assemblies. The magnetic block comprises a hollow body consisting of a first and a second shell member, identically configured with peripheral contact surfaces to contact with peripheral surfaces of other magnetic blocks of an assembly; each shell member is provided with male and female junction elements, which may be press-fitted into the female junction elements respectively into the male junction elements of another shell member in an assembled condition of the block. The junction elements extend inside the hollow body of the block in a direction parallel to a reference axis, at magnetic contact zones of the peripheral contact surface of the block; permanent magnets or ferromagnetic connection elements are housed in the female junction elements of one or both shell members of the toy block.

13 Claims, 5 Drawing Sheets

(51) Int. Cl.
*A63H 33/26* (2006.01)
*H01F 7/02* (2006.01)

(58) Field of Classification Search
USPC ..... 446/92, 137
See application file for complete search history.

(56) References Cited

U.S. PATENT DOCUMENTS

| | | | | |
|---|---|---|---|---|
| 3,601,921 | A * | 8/1971 | Strohmaier | A63H 33/046 446/92 |
| 5,746,638 | A | 5/1998 | Shiraishi | |
| 6,024,626 | A | 2/2000 | Mendelsohn | |
| 7,255,624 | B2 * | 8/2007 | Daftari | A63H 33/046 446/485 |
| 7,846,002 | B1 * | 12/2010 | Mikesell | A63H 33/042 446/91 |
| 8,850,683 | B2 * | 10/2014 | Haughey | A63H 33/046 29/428 |
| 9,751,025 | B2 * | 9/2017 | Kiribuchi | A63H 33/046 |
| 2010/0120322 | A1 * | 5/2010 | Vicentelli | A63H 33/046 446/92 |
| 2011/0317391 | A1 * | 12/2011 | Peng | A63H 33/046 361/809 |
| 2012/0322339 | A1 * | 12/2012 | Kim | A63H 33/046 446/92 |
| 2015/0065007 | A1 * | 3/2015 | Klepper | A63H 33/046 446/92 |
| 2015/0258462 | A1 | 9/2015 | Wei | |
| 2016/0367906 | A1 | 12/2016 | Purns | |
| 2018/0056204 | A1 * | 3/2018 | Knudsen | A63H 33/046 |

FOREIGN PATENT DOCUMENTS

| | | | |
|---|---|---|---|
| EP | 2086660 | A1 | 8/2009 |
| EP | 2411106 | A1 | 2/2012 |
| KR | 200263127 | Y1 | 1/2002 |
| WO | 2008043535 | A1 | 4/2008 |
| WO | 2010111189 | A1 | 9/2010 |
| WO | 2012105742 | A1 | 8/2012 |
| WO | 2015114044 | A1 | 8/2015 |

* cited by examiner

MAGNETIC TOY BLOCK

BACKGROUND OF THE INVENTION

The present invention relates to magnetic toy blocks suitable for the composition of toy assemblies for children, as well as it refers to a kit or an assembly of magnetic toy blocks identically or variously configured and provided with an innovative magnetic junction system between two shell members of each toy block, and a connection between identically or differently shaped toy blocks of the assembly.

There currently exists a large variety of magnetic toy blocks for toy compositions, in which the toy blocks, hereunder referred to also as "blocks", are configured with bodies of cubic, spherical, polyhedron or other shape, and provided with magnets to permit a firm coupling between the same blocks. Each block is thus provided with one or more magnetic connection elements at magnetic contact zones of a peripheral surface of the block; the magnetic connection elements can consist indifferently of permanent magnets, or of ferromagnetic elements, which are housed in corresponding seats inside and/or outside the body of each block.

Magnetic toy blocks for the composition of toy assemblies are disclosed in U.S. Pat. No. 2,795,893, EP 051576, U.S. Pat. No. 6,024,626, EP 2086660, and WO 2015/114044.

In particular, U.S. Pat. No. 2,795,893 discloses a cubic block, with chamfered edges, consisting of a hollow body comprising two differently shaped shell members, the peripheral edges of which are differently configured and provided with a male and female connection system; permanent magnets are fastened into corresponding inner seats on two opposite faces of the cube. A soft iron band surrounds the other faces of the cube at a connection groove. A similar solution is complex both from the constructional point of view, and assembling inasmuch as it requires different moulds for the two differently shaped shell members, and complex assembling operations that are difficult to automate.

EP051576 again shows a magnetic toy block for the composition of toy assemblies, comprising a body of cubic shape provided with permanent magnets in corresponding seats inside or outside the body; the document does not disclose any particular configuration of the block, providing a simple insertion of the magnets into seats on side faces.

U.S. Pat. No. 6,024,626 in turn discloses magnetic toy blocks for toy assemblies, in which each magnetic block comprises a cubic hollow body consisting again of two differently shaped pans, in which permanent magnets are inserted into respective housings along edges of the cube, or are simply glued to the inner surface of the single faces.

EP 2086660 still shows magnetic toy blocks of varying shape for the composition of toys for children; in particular it shows cube-shaped blocks, having a hollow body in which a freely movable magnet is housed, which is otherwise orientable with respect to the faces of the block; again, no particular structural conformation of the block is disclosed, or a mechanical connection system between the different parts that constitute the block, except for the use of an adhesive.

Lastly WO 2015/114044 is regarded as being the closest prior an according to the preamble of claim 1.

The solutions proposed so far, thus provide magnetic toy blocks formed by differently configured parts, which require the use of at least two comparatively complex and costly moulds; therefore the automation of the assembling operations of the various parts that constitute the block is difficult to achieve.

SUMMARY OF THE INVENTION

A main object of the present invention is to provide a magnetic toy block for the composition of toy assemblies, in which the block consists of two separate parts, provided with an original mechanical coupling and magnetic connection system between blocks of an assembly, and in which the two parts composing each block are configured in such a manner as to permit an extreme structural simplicity of the moulds; in this manner the moulding operations are made simultaneously cheap and fast, simplifying the automation of the assembling operations of the block.

A further object of the invention is to provide a magnetic block, as referred to above, in which one or more faces or peripheral surfaces of the block can have one or more magnetic anchoring zones for a selective connection with magnetic anchoring zones of other similarly or differently configured blocks, and in which the position of the magnetic anchoring zones can be provided on side faces during the design step, or chosen and selected during the assembling of the block.

A still further object of the invention is to provide a magnetic block (or the composition of toy assemblies, as previously defined, by means of which it is possible to use moulds having extremely simplified moulding cavities, devoid of movable parts, with a consequent greater speed of the moulding cycle; the frequency of maintenance operations of the mould is also significantly reduced.

Lastly, a further object is to provide a kit of toy blocks for composition of toy assemblies according to the present invention.

According to the present invention, a magnetic toy block has been provided suitable for the composition of an assembly for toys, comprising a hollow body having a first and a second shell member, in which each shell member is configured with peripheral walls having magnetic contact zones, and in which the block comprises a plurality of magnetic connection elements in respective housing seats at said contact zones;

in which both shell members are identically configured, each shell member comprising at least one male junction element and at least one female junction element, said male and female junction elements extending inside the hollow body in a direction parallel to a reference axis;

each male junction element and each female junction element of one of the first and second two shell members, in an assembled condition of the block being fixedly connected to a female junction element respectively to a male junction element of the other one of the shell members;

characterised in that a magnetic connection element is housed in at least one of the female junction elements of at least one of the first and second shell members;

the female junction members extending inside the hollow body of the block at said magnetic contact zones, from an inner surface of respective peripheral walls.

The magnetic block can be variously configured, for example in the shape of a cubic block, spherical, ovoid, prismatic or polyhedron shape, having flat or differently shaped side faces or peripheral surfaces that are variously configured to come in contact with mating faces or peripheral surfaces of other magnetic blocks of an assembly.

Preferably, the cube-shaped magnetic block consists of two identically configured shell members, in which the male and female junction elements extend parallel to a diagonal of the hollow body of the cubic block.

Still according to the preferential cube-shaped block, each shell member comprises three contiguous walls that converge on a vertex lying on an inner diagonal axis of hollow body corresponding to the reference axis, parallel to the male and female junction elements.

Lastly, each female junction element of each shell member of the cube shaped block is extending from a center point of a respective side face of the shell member, while each male junction element is extending from a center point of an edge between contiguous side walls of the same shell member of the block.

BRIEF DESCRIPTION OF THE DRAWINGS

These and further features of the magnetic toy block and kit for the composition of toy assemblies according to the invention, will be illustrated in greater detail with reference to the drawings, in which.

DETAILED DESCRIPTION OF THE INVENTION

Figure 1:
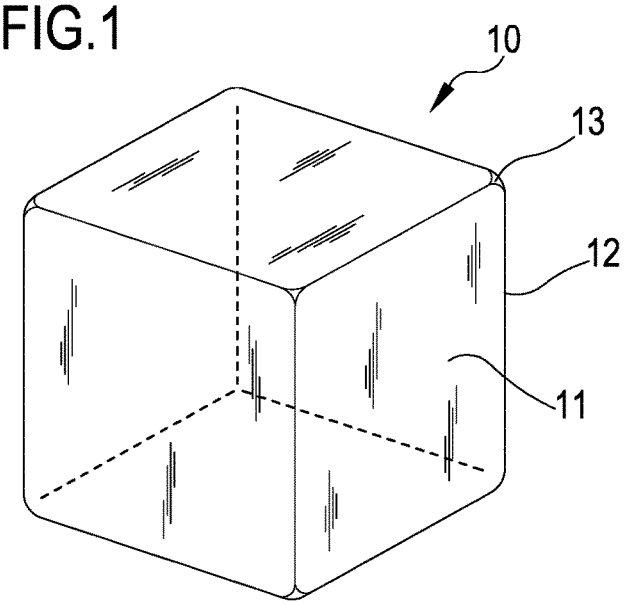
FIG. 1 is a perspective view of a cube-shaped magnetic block.

With reference to the various FIGS. 1 to 5, the innovative features of the magnetic toy block according to the invention will be now described with reference to a cube-shaped magnetic block, hereinafter also referred to as cubic block, shown in the aforementioned figures. The remaining FIGS. 6 to 11 show, still by way of non-limiting example, other possible shapes of magnetic blocks according to the present invention.

As shown in the example of FIGS. 1 to 5, the magnetic block 10 comprises a hollow body of magnetically non-conductive material, for example of moulded plastics, or other material or combination of suitable materials for the prescribed use; the magnetic block 10 has peripheral walls having an outer peripheral surface to contact other magnetic blocks of a same or different type; in particular the block 10 comprises flat side walls 11, edges 12 and vertices 13 between contiguous side walls, as schematically shown. The walls of the block 10 preferably have a thickness ranging from 0.5 to 1.5 mm, to keep at minimum the loss of magnetic force of magnets, in an assembled condition of the blocks.

Figure 2:
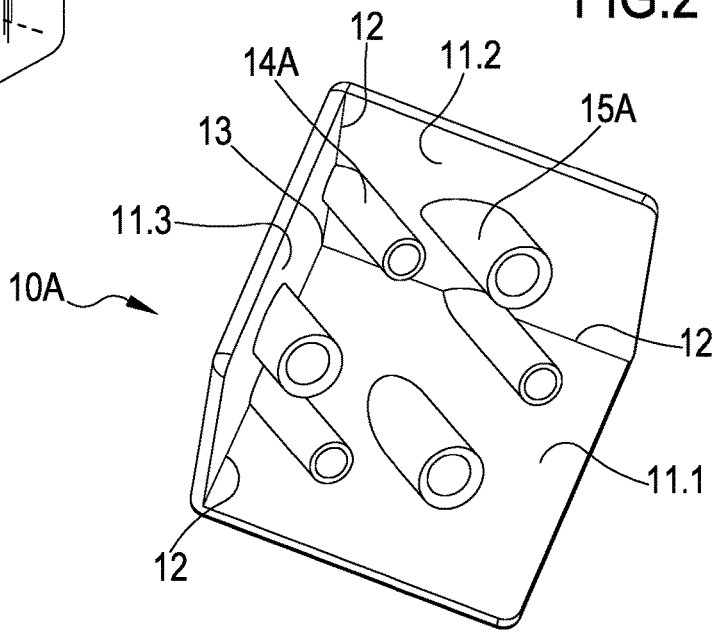
FIG. 2 is a perspective view of one of the two identical shell members, that constitute the block in FIG. 1.
Figure 3:
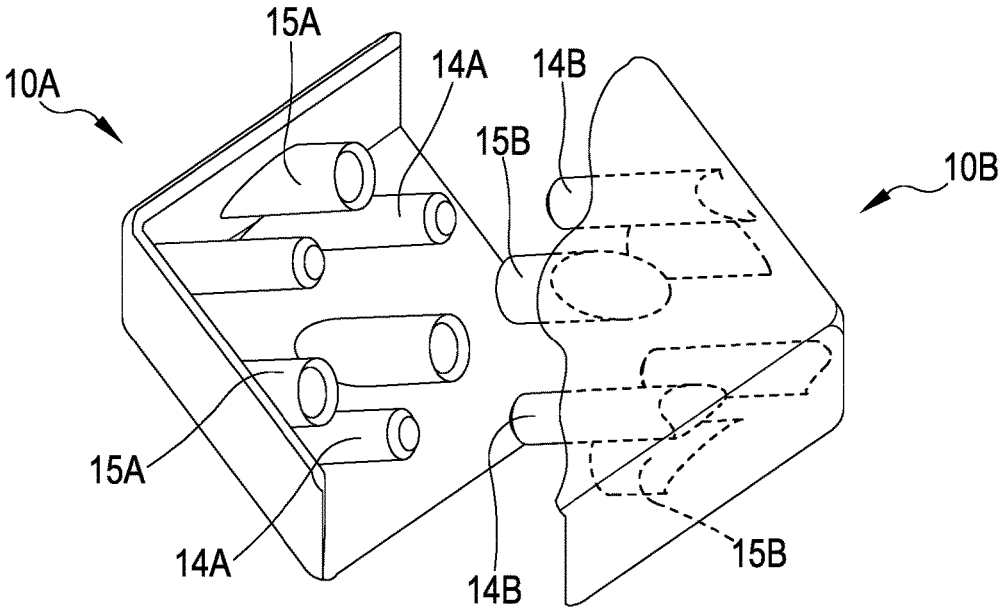
FIG. 3 shows an exploded perspective view of the two shell members of the block in FIG. 1, during assembling.

In FIGS. 2 and 3, the block 10 consists of two identically configured shell members 10A, 10B having male junction elements 14A and female junction elements 15A, respectively male junction elements 14B and female junction elements 15B configured for enabling a permanent press-fitting connection, or a connection of irreversible type.

In the case of FIG. 1 the cubic block 10 in comprises two shell members 10A, 10B each provided with three contiguous side walls 11.1, 11.2 and 11.3 having in common three edges 12 oriented at 90° to one another, and with respect to the three walls of the shell member which are converging on a vortex 13 of the same shell member (10A, 10B).

The male junction elements 14A, 14B and female junction elements 15A, 15B of each of the two shell members 10A and 10B extend inside the hollow body of the block 10 in a direction parallel to a reference axis, coinciding with a coupling direction of the two shell members; in the case of the cubic block in FIGS. 1-4, the male and female junction elements of the two shell members 10A, 10B extend parallel to a reference axis coinciding with an inner diagonal axis of the cubic block, extending between two opposite vertices 13.

There can be any number of male and female junction elements between the shell members of the block, with the junction elements arranged in any appropriate position provided that, in the assembled condition of the two shell members, each male element and each female element of one of the two shell members be axially aligned and press-fitted into or permanently connected to a corresponding female junction element, respectively into a corresponding male junction element of the other shell member, positioned at specific magnetic anchoring zones of the peripheral walls of the block.

In the case of the cubic block of FIGS. 1-4, each shell member 10A, 10B comprises a male junction element 14A, 14B that protrudes from a centre point of a respective edge 12, and a female junction element 15A, 15B that protrudes from a centre point of a respective wall 11 of the shell member.

Figure 4:
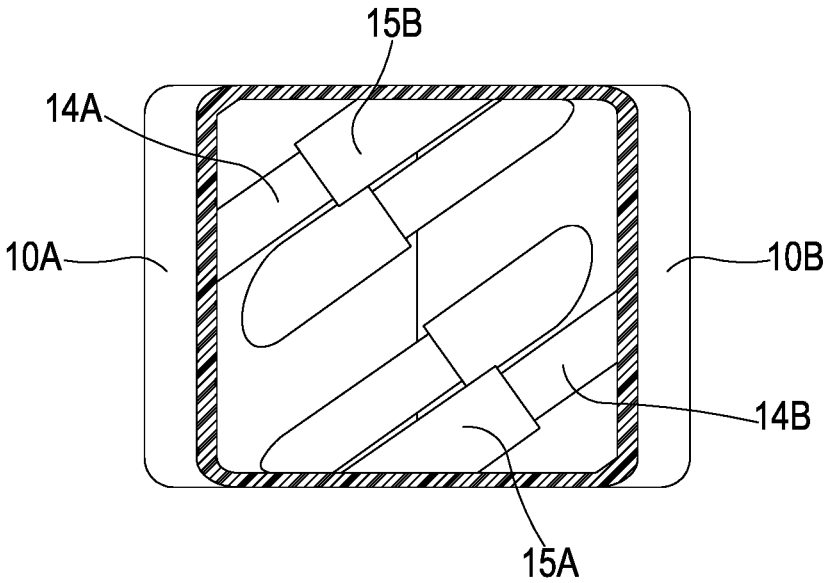
FIG. 4 is a partially sectioned view of the block in FIG. 1, in an assembled condition.

In the case of FIGS. 2, 3 and 4, each edge 12 of the two shell members 10A, 10B thus comprises a sole male junction element 14A, 14B, whereas each wall 11 of the two shell members 10A, 10B comprises a sole female junction element 15A, 15B; nevertheless, the number and the position of the male and female junction elements 14 and 15 of the two shell members could be any, in relation to the geometric shape and dimensions of each block.

As previously mentioned, one of the features of the magnetic toy block according to the invention consists of identically configuring the two shell members 10A, 10B, each with a same number of male junction elements 14A, 14B and female junction elements 15A, 15B, which are identically positioned and aligned parallel to a reference axis of the hollow body, oriented in a coupling direction between the two shell members of the block; this allows a press-fitting of each male junction element 14A of one of the shell members into a corresponding female junction element of the other one of the shell members, keeping the male and female junction elements axially aligned each others during the assembling of the block.

As initially mentioned, the magnetic blocks of known type comprise one or more magnetic connection elements consisting of permanent magnets or ferromagnetic elements positioned in corresponding housing seats inside or outside the block.

Figure 5:
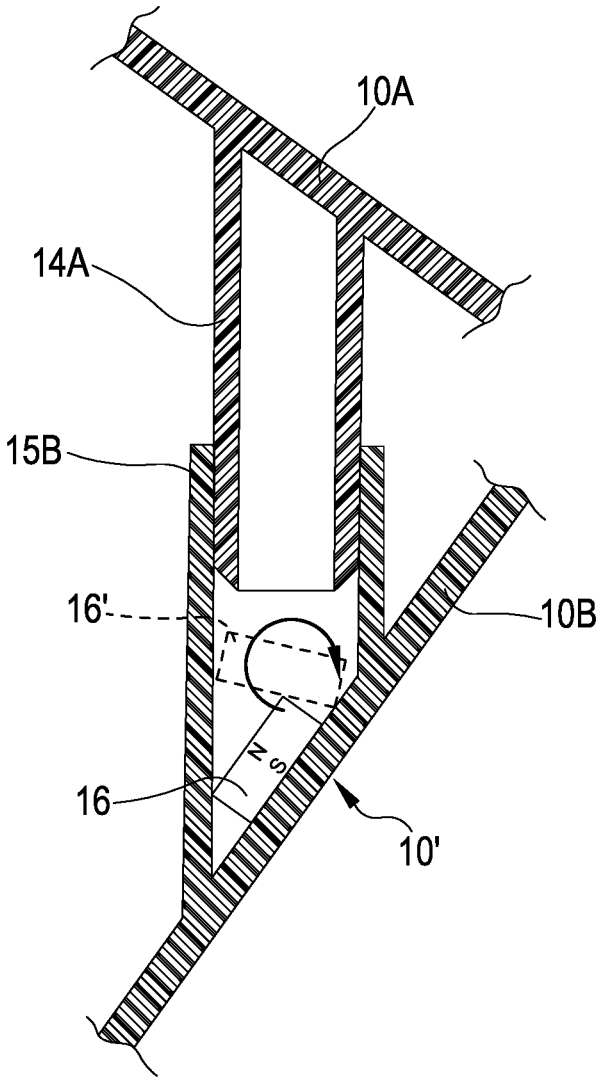
FIG. 5 is an enlarged sectional view of a male and female junction elements configured for housing a magnetic connection element according to the invention.

Accordingly, a further innovative feature of the magnetic block according to the invention, in combination with the male and female coupling system, is shown in FIG. 5 where the same reference numbers of the preceding figures have been used to indicate similar or equivalent parts.

As shown from the detail of FIG. 5, the female junction element 15B of the shell member 10B, in addition to allow the press-fitting with the male junction element 14A of the shell member 10A, in synergy with the preceding coupling function performs a second function defining the housing seat for a magnetic connection element 16, to magnetically connect adjacent blocks of any toy assembly. Again, the magnetic connection element 16 can be a permanent magnet with the magnetic poles N and S suitably oriented or orientable with respect to a magnetic contact zone 10' of the walls, or coupling surfaces between blocks, or can be a ferromagnetic element.

The magnetic connection element 16, as shown with 16' in FIG. 5 is freely movable or rotatable housed in the female junction element 15B; in this manner, when two magnetic toy blocks are brought up against one another, the respective magnets 16 can move and rotate to automatically orient one of poles N or S of a magnet 16 of a block 10, towards a pole S or N of opposite polarity of magnet 16, or towards a ferromagnetic element of the other block 16, during the construction of an assembly.

Alternatively or in combination with freely movable magnetic connection elements, it is possible to provide an arrangement in a fixed manner, without any possibility of the magnetic connection elements to move or rotate, for example by configuring the male junction element 14A of a shell member to extend up to a short space from the bottom end of the female element 15B, that is the inner surface of the side wall of the other one of the shell members, to prevent any movement of the magnet 16 or ferromagnetic element previously threaded into the female element 15B.

The male junction elements 14A, 14B and the female junction elements 15A, 158 can be configured in any manner provided that they are suitable for permitting their press-fitting. In the case shown, both male junction elements and female both junction elements have a circular cross section; the outer diameter of the male junction element is slightly greater than the inner diameter of the female junction element to fixedly press-fitting the male and female junction elements in an assembled condition of the block. Nevertheless, alternatively to the circular cross section, the male and female junction elements could have any other shape, other than that shown, for example they could have square cross section or could be configured with ribs and/or longitudinal slots, provided that they are suitable for permitting an irreversible press-fitting or coupling with slight interference thereof.

In FIGS. 1 to 5, a cubic magnetic block has been shown; nevertheless, although the general features of the present invention remain the same, the magnetic block could have any other geometrical shape, for example it could consist of a hollow body of a polyhedron shape having a number of flat walls, or otherwise shaped walls, or a spherical, ovoid, cylindrical or prismatic shape, provided that it consists of two identically configured shell elements having an identical number of male junction elements and of female junction elements for blocks of a toy assembly.

Some embodiments are shown in FIGS. 6 to 11 of the attached drawings, in which the same reference numbers as for the preceding figures have been used again to indicate similar or equivalent parts.

Figure 6:
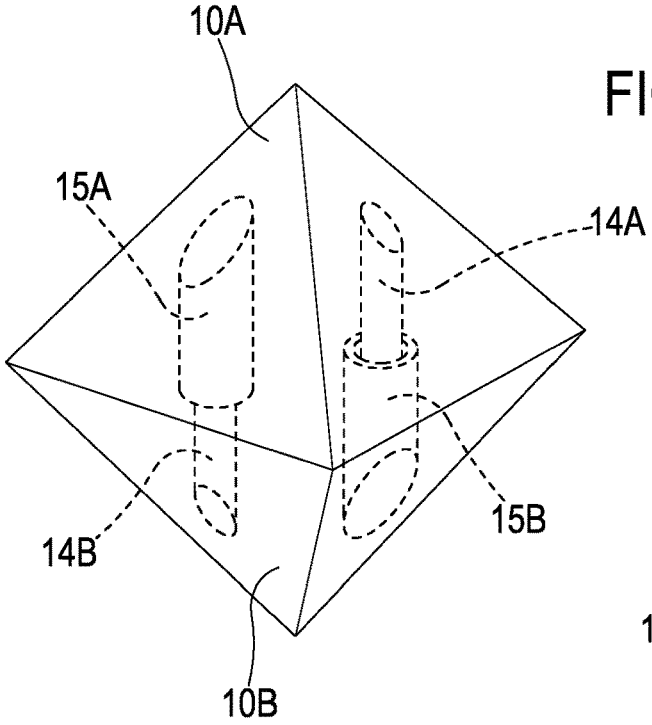
FIG. 6 is a perspective view of a magnetic octahedron-shaped block.
Figure 7:
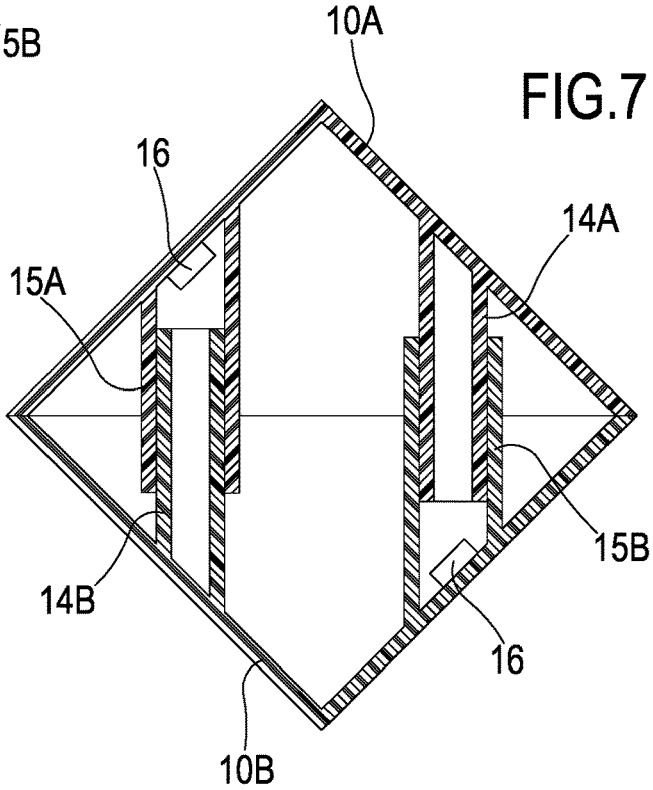
FIG. 7 is a sectional view of the octahedron block in FIG. 6.

In particular, FIGS. 6 and 7 show a magnetic octahedron-shaped block, having a hollow body consisting again of two identically shaped shell members 10A, 10B, each provided with a sole male junction element 14A, 14B and with a sole female junction element 15A, 15B axially aligned and protruding inside from the inner surface of respective side walls, and configured for housing a permanent magnet 16 or a ferromagnetic element as previously mentioned.

Figure 8:
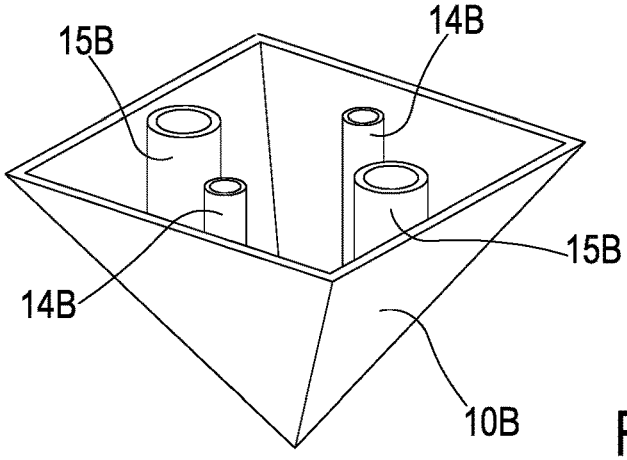
FIG. 8 is a perspective view of one of the two shell members different from the octahedron block in FIG. 6.

FIG. 8 shows, still by way of example, a possible variation of the shell members of the tetrahedron of FIG. 6, in particular the shell member 10B. In the case of FIGS. 6 and 7, one male and one female junction element is positioned at respective opposite side walls of the two shell members; otherwise, in the case of FIG. 8 each shell member comprises two male junction elements 14B on two opposite side walls of the octahedron, and comprises two female junction elements 15A, 15B on the other opposite side walls. Thus, during the assembling of the two shell members 10A, 10B it will be necessary to rotate one shell member with respect to the other one, according to a reference axis parallel to the junction elements, so as to orient and align each male junction element and each female junction element of one of the two shell members, with a corresponding female junction elements, respectively with a corresponding male junction elements of the other shell member.

Figure 9:
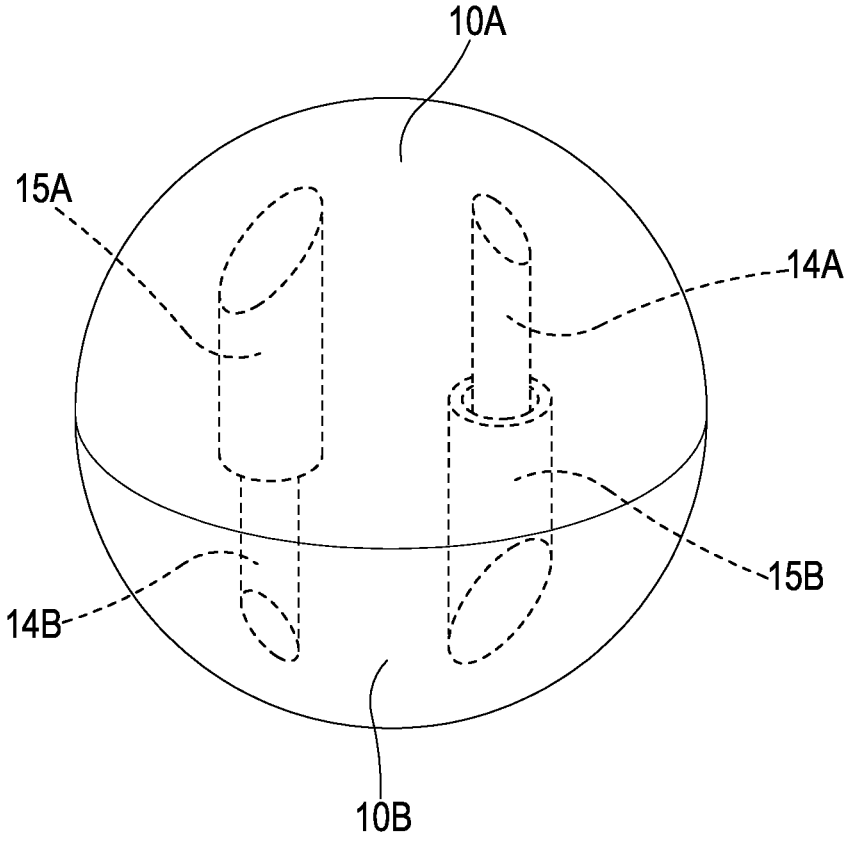
FIG. 9 shows a sphere-shaped magnetic block.
Figure 10:
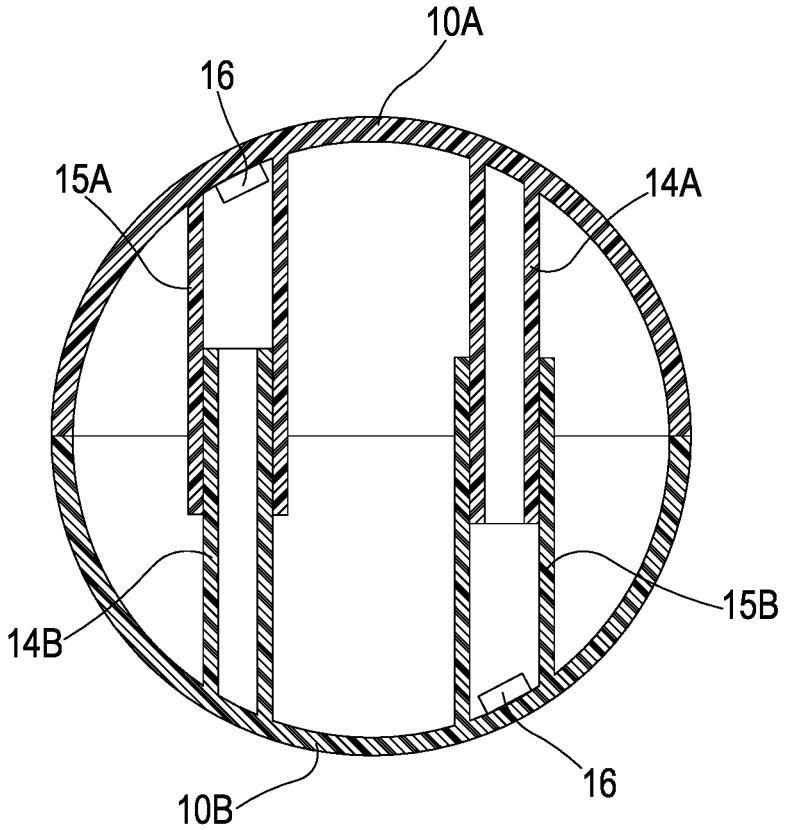
FIG. 10 is a sectional view of the sphere block in FIG. 9.

FIGS. 9 and 10 show on the other hand a magnetic block according to the invention having a hollow body of spherical shape. Again, the two hemispherical shell members 10A and 10B are identically configured with male junction elements 14A, 14B and female junction elements 15A, 15B for housing magnets 16 or ferromagnetic elements, in which the male and female junction elements of a shell member in an assembled condition are axially aligned and press-fitted into the female junction elements, respectively male junction elements of the other shell member of the block.

Figure 11:
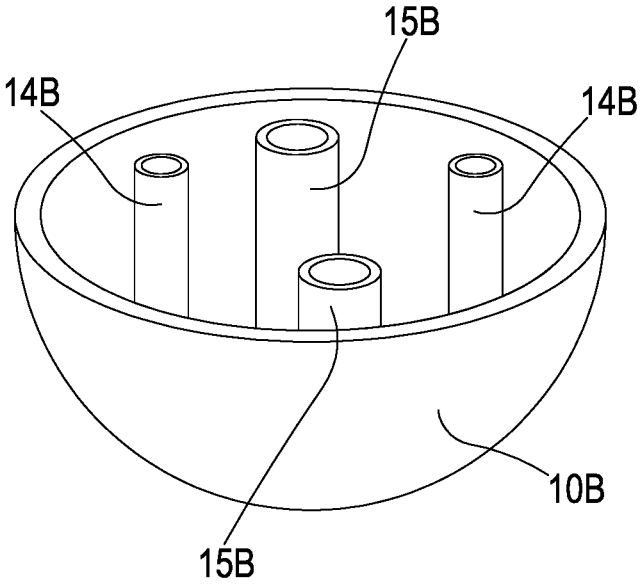
FIG. 11 is a perspective view of one of the two shell members, according to a solution different from the sphere block in FIG. 9.

FIG. 11 shows a possible embodiment of the hemispherical shell members 10A and 10B, in which two male junction elements 14B are positioned at a first diametric direction of the shell member, whereas two female junction elements 15B are positioned at a second diametric direction of the shell member, orthogonal to the preceding diametric direction.

In all cases, the number and the position of the male junction elements and of the female junction elements can vary and differ from what has been shown, always maintaining an identical configuration of the two shell members, in combination with the housing of the magnetic connection elements 16, selectively arrangeable in one or more female junction elements of one or both shell members of the block, at the assembling.

Figure 12:
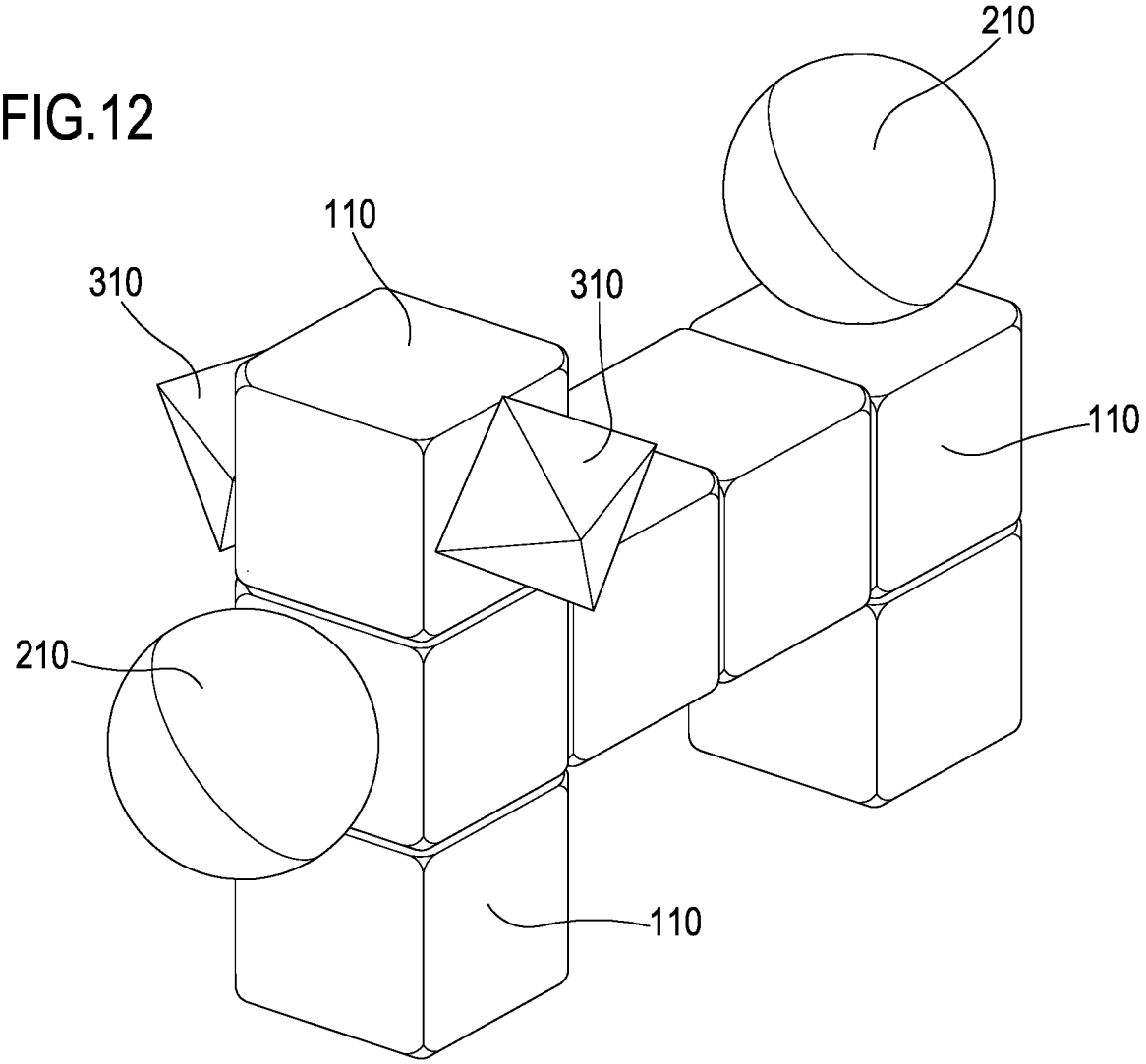
FIG. 12 shows a perspective view of a toy composition comprising a number of magnetic toy blocks of the preceding figures.

FIG. 12 lastly shows a toy assembly of a kit for a composition of magnetic toy blocks according to the invention, magnetically coupled so as to imitate an animal; in particular the composition of FIG. 12 comprises a plurality of toy blocks of cubic shape 110, imitating the body of the animal, a first spherical block 210 imitating the nose and a second spherical block 210 imitating the tail, whereas two octahedron-shaped blocks 310 are positioned to imitate the ears; obviously by differently combining and assembling magnetic blocks of different shapes or types, it is possible to make any composition.

The single magnetic blocks can be optionally provided with decorative elements on the external surface thereof such as letters, numbers, figures and/or differently coloured parts, so as to stimulate creativity and the use of the blocks in making up any sort of toy assembly.

In all the cases, from what has been illustrated and described, it is clear that numerous economic and productive advantages are obtained by a magnetic toy block according to the invention, compared to conventional toy blocks. In fact, the magnetic block according to the invention, consisting of two identically shaped shell members, provided with male and female junction elements configured for a press-fitting and housing permanent magnets and/or ferromagnetic elements, or equivalent magnetic connection elements, can be produced in a simpler and cheaper way, both from investments and production point of view and of assembly times, in an easily automatable manner.

In fact, in the case of blocks obtained by moulding of plastics, it is possible to use a sole type of mould, configured with one or more moulding cavities of the same type, corresponding to the shape of the two shell members of the block; this allows the use of a cheaper mould, having a pluralities of moulding cavities per surface unit of the mould, greater moulding speed and productivity; the structural simplicity of the mould, due to the identical configuration of the two shell members of each single magnetic block, lastly facilitates automation of the assembling operations.

The disposition of the magnet and/or ferromagnetic elements inside the female junction elements according to the present invention, besides being a distinguishing and an innovative feature, compared to the known prior art, may be advantageously used with magnetic toy blocks having planar peripheral walls, in particular with a cube shaped magnetic toy block. The solution according to the present invention provides the advantage of positioning the magnet and/or ferromagnetic elements at a center point of each peripheral wall, avoiding the use of separate elements to assemble the shell members of the block, in which the use of separate assembling elements requires more complex time-consuming assembling operations, involving additional costs.

Furthermore, the magnetic block according to the present invention improves the playability, during the construction of a toy assembly, by automatically allowing a centered disposition of each toy block in the assembled condition of the toy blocks.

The invention claimed is:

1. A magnetic toy block suitable for the composition of toy assemblies, comprising a hollow body having a shape of a cube and including first and second identically configured hollow shell members including peripheral walls having magnetic contact zones, each shell member including at least one male junction element and at least one female junction element inside said hollow body, said male and female junction elements extending in a direction parallel to a reference axis coincident with an internal diagonal of said hollow body extending between opposite vertices where said peripheral walls converge, each male junction element and each female junction element of one of said first shell member being connected with a female junction element and a male junction element, respectively, of said second shell member in an assembled condition of the toy block; and a magnetic element arranged in at least one of said female junction elements of at least one of said first and second shell members, said female junction elements extending inside said hollow body of the magnetic toy block from an inner surface of respective peripheral walls at said magnetic contact zones.

2. The magnetic toy block according to claim 1, wherein each male junction element of a shell member is press-fitted into a corresponding female junction element of the other shell member of the magnetic toy block.

3. The magnetic toy block according to claim 1, wherein said hollow body is configured with peripheral walls having one of planar and shaped outer surfaces.

4. The magnetic toy block according to claim 1, wherein each shell member comprises three contiguous walls that converge toward a vertex of the said cube hollow body.

5. The magnetic toy block according to claim 1, wherein said male and female junction elements are configured with a circular cross section.

6. The magnetic toy block according to claim 1, wherein said magnetic members are freely movable within said female junction elements of at least one shell member of the magnetic toy block.

7. The magnetic toy block according to claim 1, wherein said magnetic members comprise at least one of permanent magnets and ferromagnetic elements.

8. An assembly of magnetic toy blocks for a toy composition, comprising at least one magnetic toy block according to claim 1.

9. The assembly of claim 8, and further comprising a plurality of magnetic toy blocks, wherein said hollow bodies of the magnetic toy blocks are configured with at least one of cubic, polyhedral, prismatic, cylindrical, spherical, and ovoidal geometric shapes.

10. The assembly of claim 8, and further comprising a plurality of magnetic toy blocks configured with peripheral walls selected from at least one of planar and shaped outer surfaces.

11. The assembly of claim 8, wherein each male junction element of a shell member is press-fitted into a corresponding female junction element of the other shell member of each magnetic toy block.

12. A kit of a toy blocks suitable for a composition of a toy assembly, comprising a plurality of magnetic toy blocks according to claim 1.

13. A magnetic toy block suitable for the composition of toy assemblies, comprising a hollow body including first and second identically configured shell members including peripheral walls having magnetic contact zones, each shell member including at least one male junction element and at least one female junction element inside said hollow body, said male and female junction elements extending in a direction parallel to a reference axis of said hollow body, each female junction element extending from a centre point of a respective side wall of said first and second shell members and each male junction element extending from a centre point of a respective edge between contiguous side walls of said first and second shell members of the magnetic toy block, each male junction element and each female junction element of one of said first shell member being connected with a female junction element and a male junction element, respectively, of said second shell member in an assembled condition of the toy block; and a magnetic element arranged in at least one of said female junction elements of at least one of said first and second shell members, said female junction elements extending inside said hollow body of the magnetic toy block from an inner surface of respective peripheral walls at said magnetic contact zones.

* * * * *